US009151093B2

(12) United States Patent
Lin

(10) Patent No.: US 9,151,093 B2
(45) Date of Patent: Oct. 6, 2015

(54) LATCH ASSEMBLY FOR A DOUBLE DOOR

(71) Applicant: I-TEK METAL MFG. CO., LTD., Tainan (TW)

(72) Inventor: Hsi-Ting Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 50 days.

(21) Appl. No.: 14/202,069

(22) Filed: Mar. 10, 2014

(65) Prior Publication Data

US 2015/0252597 A1 Sep. 10, 2015

(51) Int. Cl.
*E05C 1/02* (2006.01)
*E05C 1/08* (2006.01)
*E05B 63/20* (2006.01)

(52) U.S. Cl.
CPC ..... *E05C 1/08* (2013.01)

(58) Field of Classification Search
CPC ..... E05C 1/08; E05C 1/002; E05C 1/085; E05C 1/12; E05C 7/00; E05C 7/04; E05C 7/045; E05C 7/06
USPC ..... 292/5, 6, 32, 33, 41, 42, 137, 156, 157, 292/162–164, 169, 174, 175, 138, 145–147, 292/192, 332, 335, 337, 169.14, 169.18, 292/DIG. 15, DIG. 21, 191, 153; 70/108–111, 106, 107
See application file for complete search history.

(56) References Cited

U.S. PATENT DOCUMENTS

| | | | | | |
|---|---|---|---|---|---|
| 161,705 | A * | 4/1875 | Robinson | 292/191 |
| RE8,008 | E * | 12/1877 | Robinson | 292/191 |
| 279,837 | A * | 6/1883 | Sparks | 292/191 |
| 327,833 | A * | 10/1885 | Sparks | 292/191 |
| 1,126,180 | A * | 1/1915 | Cleaver | 292/191 |
| 1,338,713 | A * | 5/1920 | Toney | 292/33 |
| 3,148,524 | A * | 9/1964 | Yulkowski | 70/107 |
| 3,172,691 | A * | 3/1965 | Russell | 292/163 |
| 3,455,591 | A * | 7/1969 | Powers | 292/335 |
| 6,393,878 | B1 * | 5/2002 | Fayngersh et al. | 70/107 |
| 6,409,231 | B1 * | 6/2002 | Rusiana | 292/33 |
| 8,556,306 | B1 | 10/2013 | Lin | 292/166 |
| 8,562,032 | B1 * | 10/2013 | Lin | 292/166 |
| 8,702,132 | B2 * | 4/2014 | Tien | 292/219 |
| 2008/0246288 | A1 * | 10/2008 | Hodgin et al. | 292/244 |
| 2014/0217750 | A1 * | 8/2014 | Lin | 292/156 |
| 2014/0265355 | A1 * | 9/2014 | Tien | 292/21 |

FOREIGN PATENT DOCUMENTS

JP 06081531 A * 3/1994

* cited by examiner

*Primary Examiner* — Alyson M Merlino

(74) *Attorney, Agent, or Firm* — Alan D. Kamrath; Kamrath IP Lawfirm, P.A.

(57) ABSTRACT

A latch assembly (10) is mounted to a follower door (275) of a double door (257) and includes a latch (231) and a pressing board (453) pivotably received in a cutout (411) of the latch (231). When the follower door (275) moves from an open position to a closed position, a pressing side (457) of the pressing board (453) is pressed by a top beam (35) of a door frame (31). The pressing board (453) pivots and presses against a bottom face (413) of the cutout (411) of the latch (231), moving the latch (231) from an unlatching position to the latching position until the pressing side (457) of the pressing board (453) completely enters the cutout (411), and then a slant face (236) of the latch (231) presses against the door frame (31), causing movement of the latch (231) from the latching position to the unlatching position.

2 Claims, 12 Drawing Sheets

LATCH ASSEMBLY FOR A DOUBLE DOOR

BACKGROUND OF THE INVENTION

The present invention relates to a latch assembly and, more particularly, to latch assembly for locking a follower door of a double door.

A double door generally includes a primary door and a follower door pivotably mounted to two vertical beams of a door frame. A lock is mounted to the primary door and includes a handle on a side of the primary door and a first latch on an end face of the primary door. The first latch can be retracted into the primary door upon pivotal movement of the handle. A latch assembly is mounted to an upper end of the follower door. The latch assembly includes an actuation latch extending beyond an end face of the follower door and a second latch normally extending beyond an upper face of the follower door. When the follower door is moving from an open position to a closed position, the second latch of the latch assembly is moved from an extended, latching position to a retracted, unlatching position by a faceplate mounted to the door frame. When the follower door is in the closed position, the second latch of the latch assembly is engaged in a groove in the door frame to lock the follower door. Since the first latch of the lock on the primary door is engaged with a receptacle in the follower door, the primary door can not be opened, either. Thus, the double door can be reliably locked. However, the faceplate for pressing against the latch is apt to become loosened after a period of time and moves to a position preventing the latch in the latching position from disengaging from the faceplate. Thus, the follower door can not be smoothly opened.

Thus, a need exists for a latch assembly for reliably locking a follower door in the closed position while assuring smooth operation of the latch.

BRIEF SUMMARY OF THE INVENTION

The present invention solves this need and other problems in the field of reliable operation of a double door by providing a latch assembly including a base having two sidewalls and an intermediate wall extending between the sidewalls. A slot is defined in the intermediate wall. The intermediate wall of the base is adapted to be mounted to an end face of a follower door of a double door further including a primary door. The follower door includes an interior space. The sidewalls are adapted to be received in the interior space of the follower door. The follower door is pivotable between a closed position and an open position. A movable member is received between the sidewalls of the base and is movable along a first axis between an engagement position and a disengagement position. The movable member includes two lateral walls spaced from each other along a second axis perpendicular to the first axis. The movable member further includes a connecting portion extending between the lateral walls. The movable member further includes an actuating groove defined in the connecting portion. The actuating groove is aligned with the slot of the base.

A latch includes an engagement end fixedly coupled to the movable member. The latch further includes a locking end having a slant face. The latch further includes a first surface and a second surface spaced from the first surface along the second axis. The latch further includes a cutout extending from an end face of the locking end toward but spaced from the engagement end along the first axis. The cutout extends to the first and second surfaces and the slant face of the latch. The cutout includes a bottom face between the locking end and the engagement end. The latch and the movable member are jointly movable. The latch is movable along the first axis between a latching position corresponding to the engagement position of the movable member and an unlatching position corresponding to the disengagement position of the movable member. The locking end of the latch in the unlatching position is adapted to be received in the follower door. The locking end of the latch in the latching position is adapted to extend out of the follower door into a groove in a top beam of a door frame to which the double door is pivotably mounted.

A pressing board is received in the cutout of the latch. The pressing board includes two lateral sides spaced from each other along a third axis perpendicular to the first and second axes. The pressing board further includes a pressing side extending between the lateral sides. The pressing side has first and second ends. The pressing board further includes an abutment side extending between the lateral sides. The abutment side includes a first end connected to the second end of the pressing side and a second end. The pressing board further includes an arcuate side extending between the lateral sides. The arcuate side includes a first end connected to the second end of abutment side and a second end connected to the first end of pressing side. A pivotal portion is formed between the second end of the pressing side and the first end of the abutment side. An actuating portion is formed between the second end of the abutment side and the first end of the arcuate side. The pressing side faces the first surface of the latch in the latching position. A portion of the pressing side adjacent to the first end of the pressing side is located outside of the slant face of the latch. The abutment side faces the bottom face of the cutout of the latch in the latching position.

A coupling member includes a top face and a bottom face spaced from the top face along the first axis. The coupling member further includes a coupling hole extending from the top face through the bottom face of the coupling member. The pivotal portion of the pressing board is pivotably mounted to the coupling member. The latch and the pressing board extend through the coupling hole. The coupling member is adapted to be fixed to the top face of the follower door.

When the follower door is in the open position, the latch is not aligned with the groove. When the follower door is in the closed position, the latch is aligned with the groove.

When the follower door moves from the open position to the closed position, the pressing side of the pressing board is pressed by the top beam of the door frame, the pressing board pivots and presses against the bottom face of the cutout of the latch by the actuating portion, moving the latch from the unlatching position to the latching position until the pressing side of the pressing board completely enters the cutout of the latch, and then the slant face of the latch presses against the door frame, causing movement of the latch from the latching position to the unlatching position.

The latch is moved from the unlatching position to the latching position when the follower door is in the closed position.

When an end face of the primary door is not aligned with the end face of the follower door, the movable member is moved from the engagement position to the disengagement position by the actuating groove to cause movement of the latch from the latching position to the unlatching position.

The latch assembly uses a pressing board to press against and move the latch from the latching position to the unlatching position without the need of a faceplate on the door frame. Thus, the follower door can smoothly be moved to the closed position while avoiding the disadvantage of loosening of the faceplate causing potential operational difficulties of the latch.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
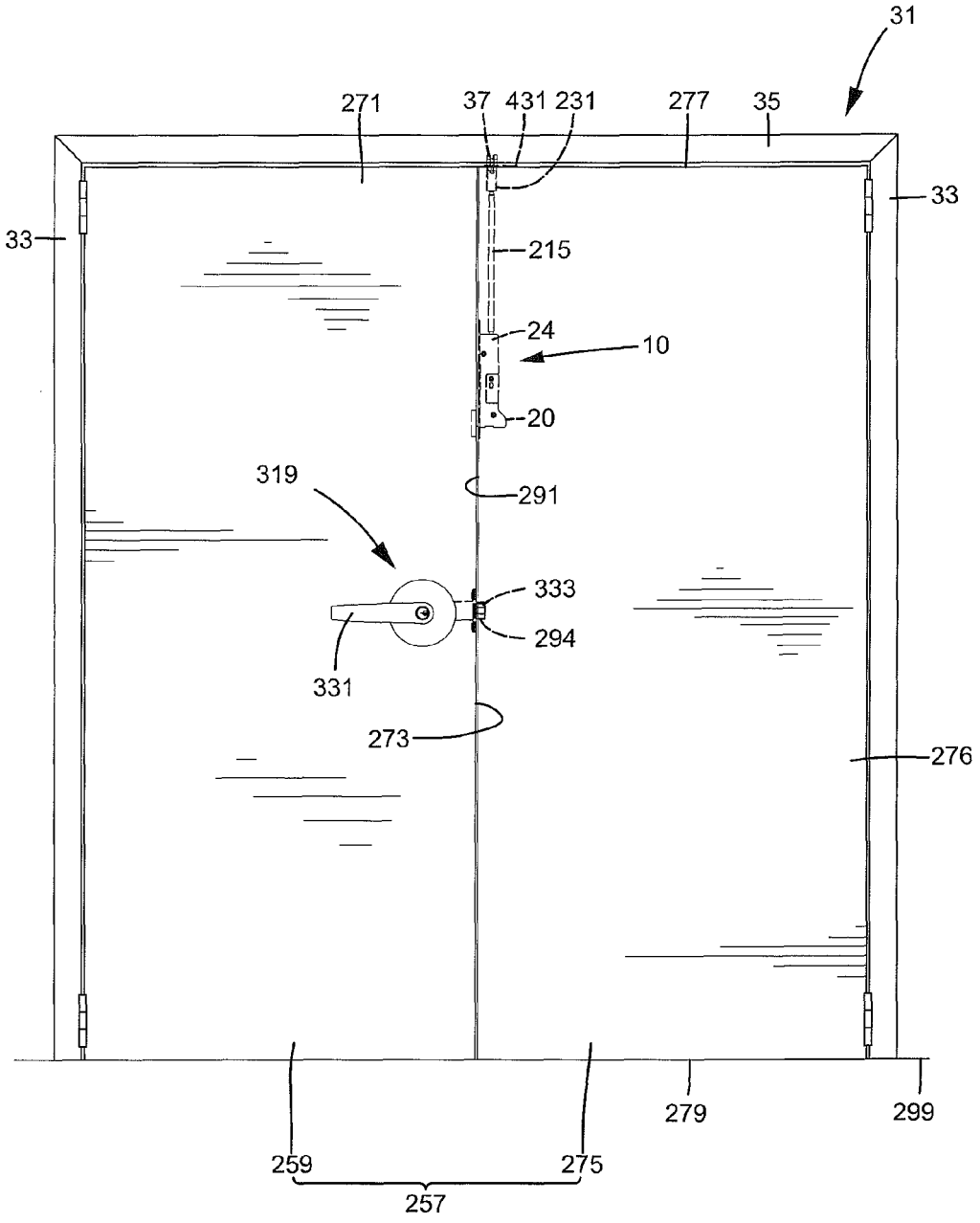
FIG. 1 is a diagrammatic front view of a double door to which a latch assembly according to the present invention is mounted.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "upper", "lower", "top", "bottom", "inner", "outer", "end", "portion", "section", "vertical", "length", "axial", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIG. 1 shows a latch assembly 10 mounted to a double door 257. Double door 257 is mounted to a door frame 31 on a floor or ground 299. Door frame 31 includes two spaced vertical beams 33 and a top beam 35 extending between upper ends of vertical beams 33. Top beam 35 includes a groove 37.

Figure 10:
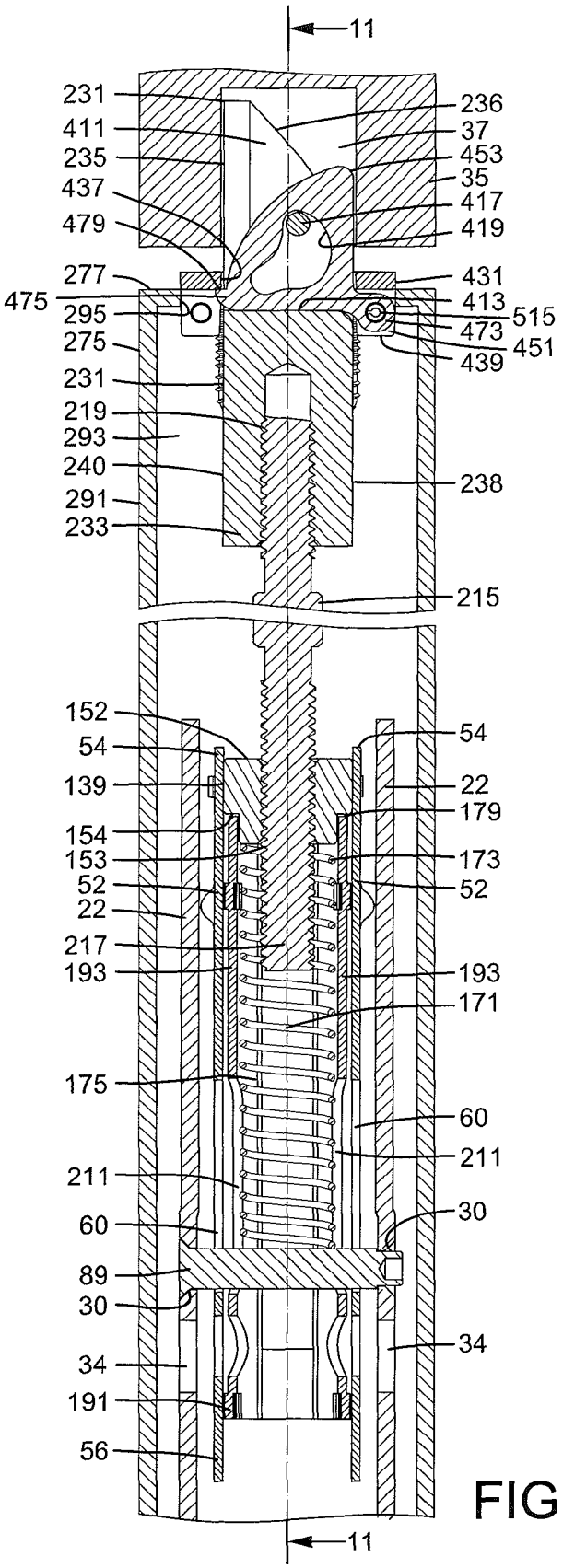
FIG. 10 is a view similar to FIG. 8, with the follower door further pivoted to the closed position, and the latch and the pressing board extending into a groove in the top beam to lock the follower door in place.
Figure 11:
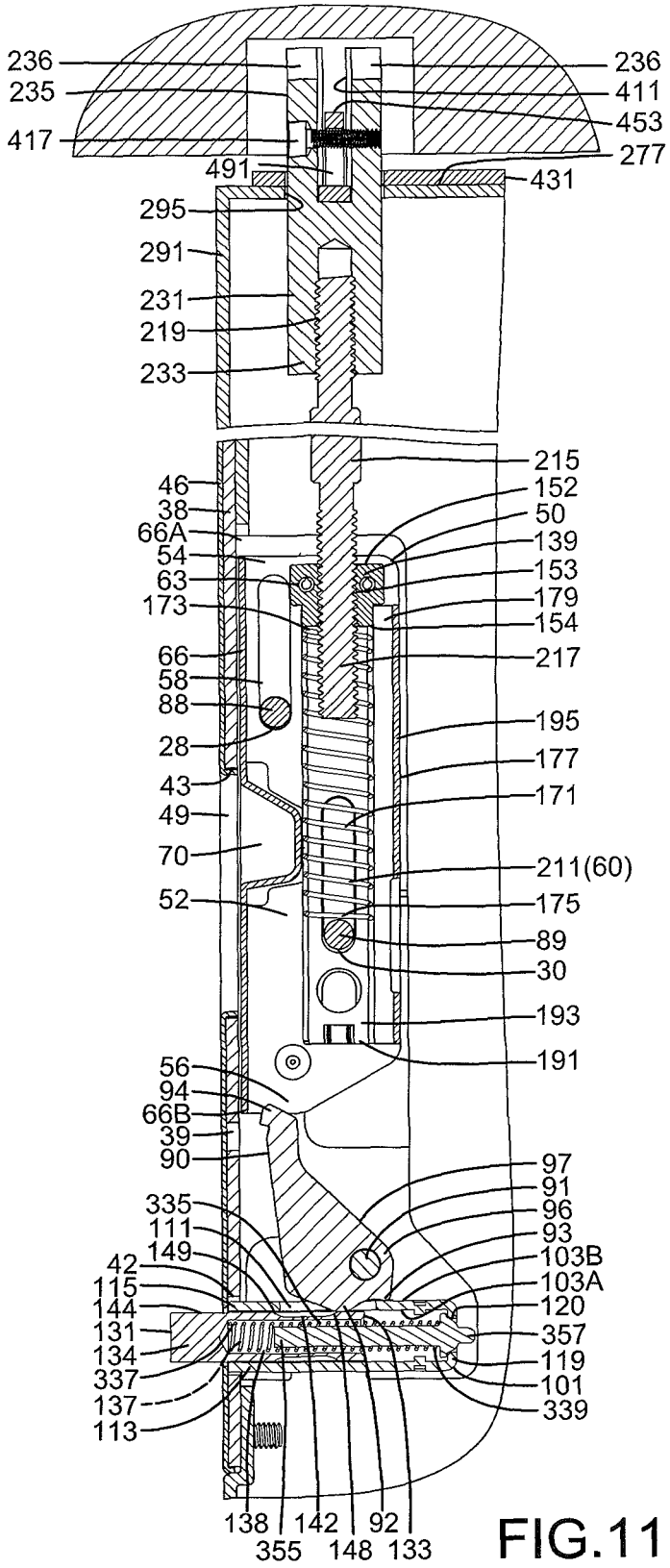
FIG. 11 is a cross sectional view taken along section line 11-11 of FIG. 10.
Figure 12:
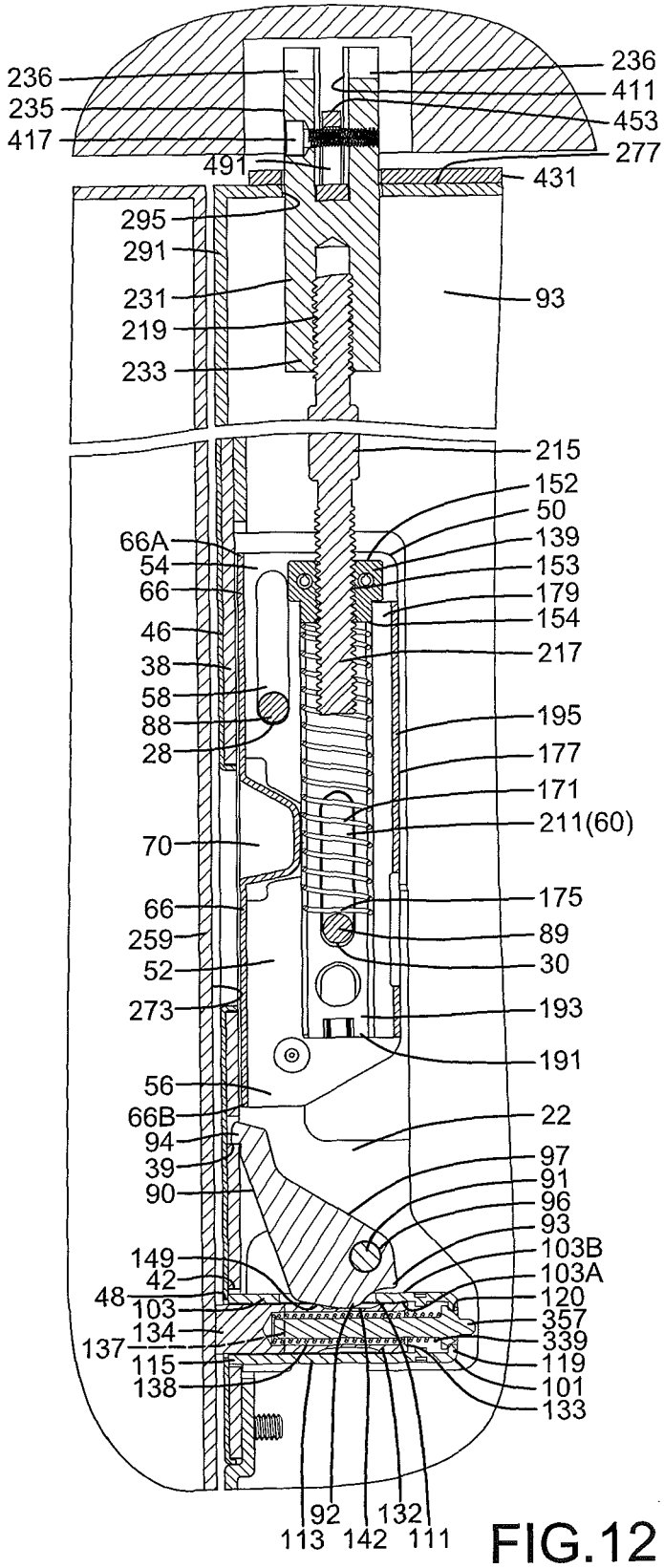
FIG. 12 is a view similar to FIG. 11, illustrating movement after the primary door is closed.

In the form shown, double door 257 includes a primary door 259 pivotably mounted to one of vertical beams 33 and a follower door 275 pivotably mounted to the other vertical beam 33. Follower door 275 includes an interior space 293. Primary door 259 includes two sides 271 and an end face 273 extending between sides 271 and extending perpendicularly to ground 299. Follower door 275 includes two sides 276, a top face 277 extending between sides 276 and facing top beam 35, and a bottom face 279 extending between sides 276 and facing ground 299. Top face 277 includes a mounting hole 295 in communication with interior space 293. Follower door 275 further includes an end face 291 extending between sides 276 and between top and bottom faces 277 and 279. An engagement hole 297 and a receptacle 294 are defined in end face 291. Follower door 275 is pivotable about a first axis X perpendicular to ground 299 between an open position (FIG. 6) and a closed position (FIGS. 10-12). When follower door 275 is in the open position, mounting hole 295 is not aligned with groove 37. When follower door 275 is in the closed position, mounting hole 295 is aligned with groove 37.

A door lock 319 is mounted to primary door 259. Door lock 319 can be of any desired form as conventional including but not limited to of a commercially available type. In the form shown, door lock 319 includes a latch 333 and a handle 331 operatively connected to latch 333. Handle 331 is located on one of sides 271 of primary door 259. Pivotal movement of handle 331 causes movement of latch 333 from an extended position outside of end face 273 of primary door 259 to a retracted position inside of primary door 259. When follower door 275 is in the closed position, end face 273 of primary door 259 is aligned with end face 291 of follower door 275, with a gap existed between end faces 273 and 291, and with latch 333 engaged in receptacle 294 of follower door 275.

Figure 2:
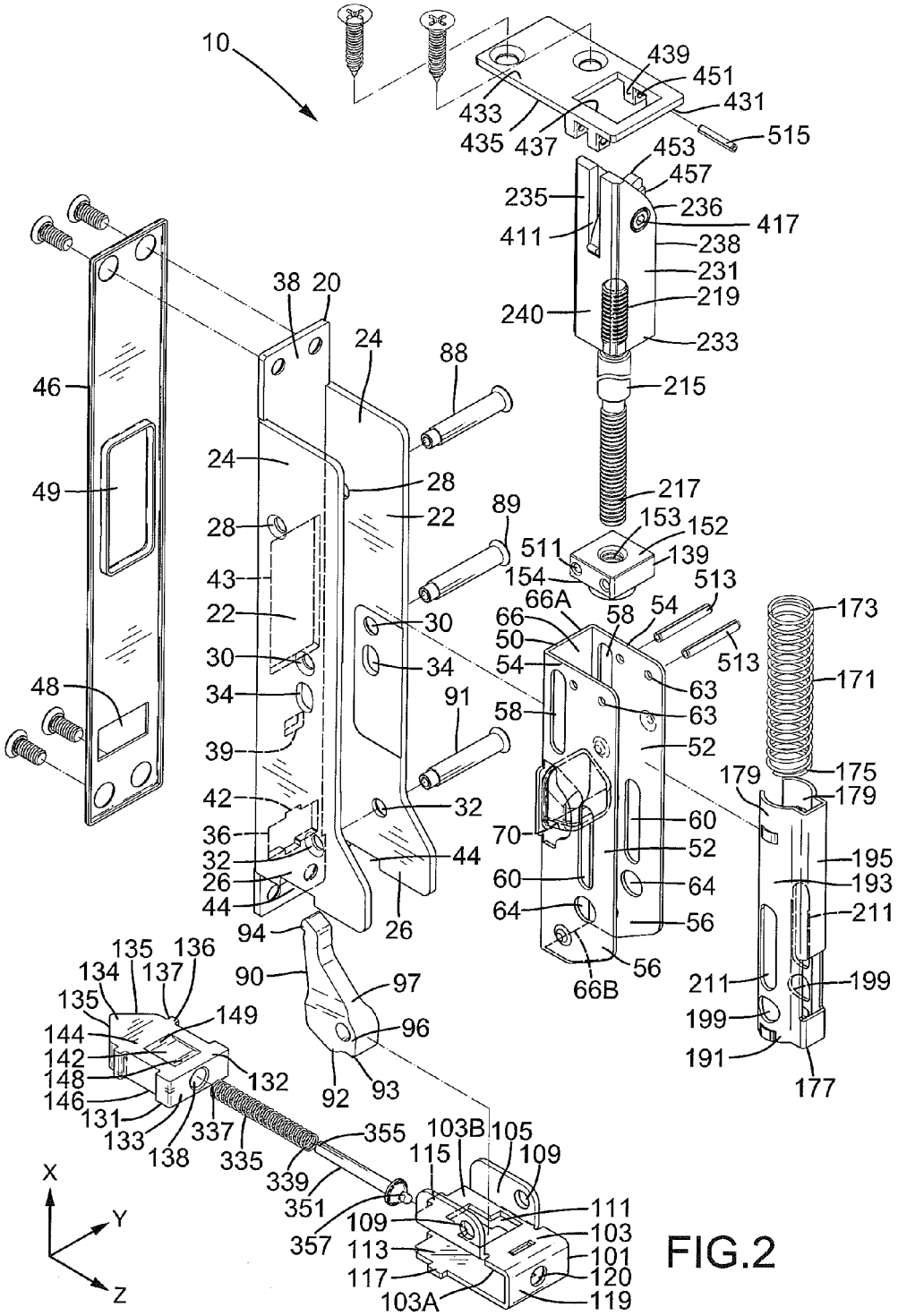
FIG. 2 is an exploded, perspective view of the latch assembly of FIG. 1.
Figure 3:
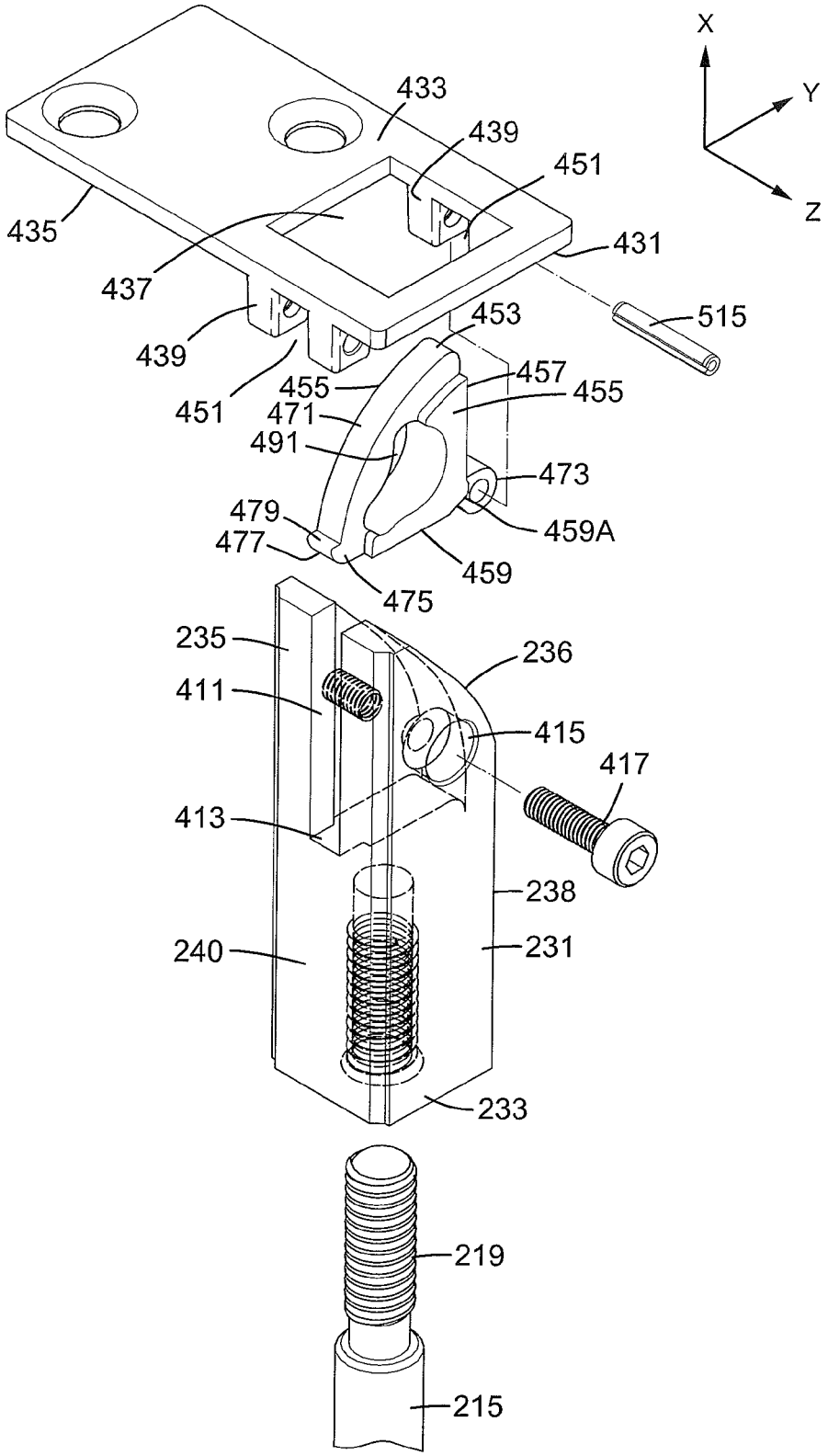
FIG. 3 is an exploded, perspective view of a connecting rod, a latch, and a pressing board of the latch assembly of FIG. 1.
Figure 4:
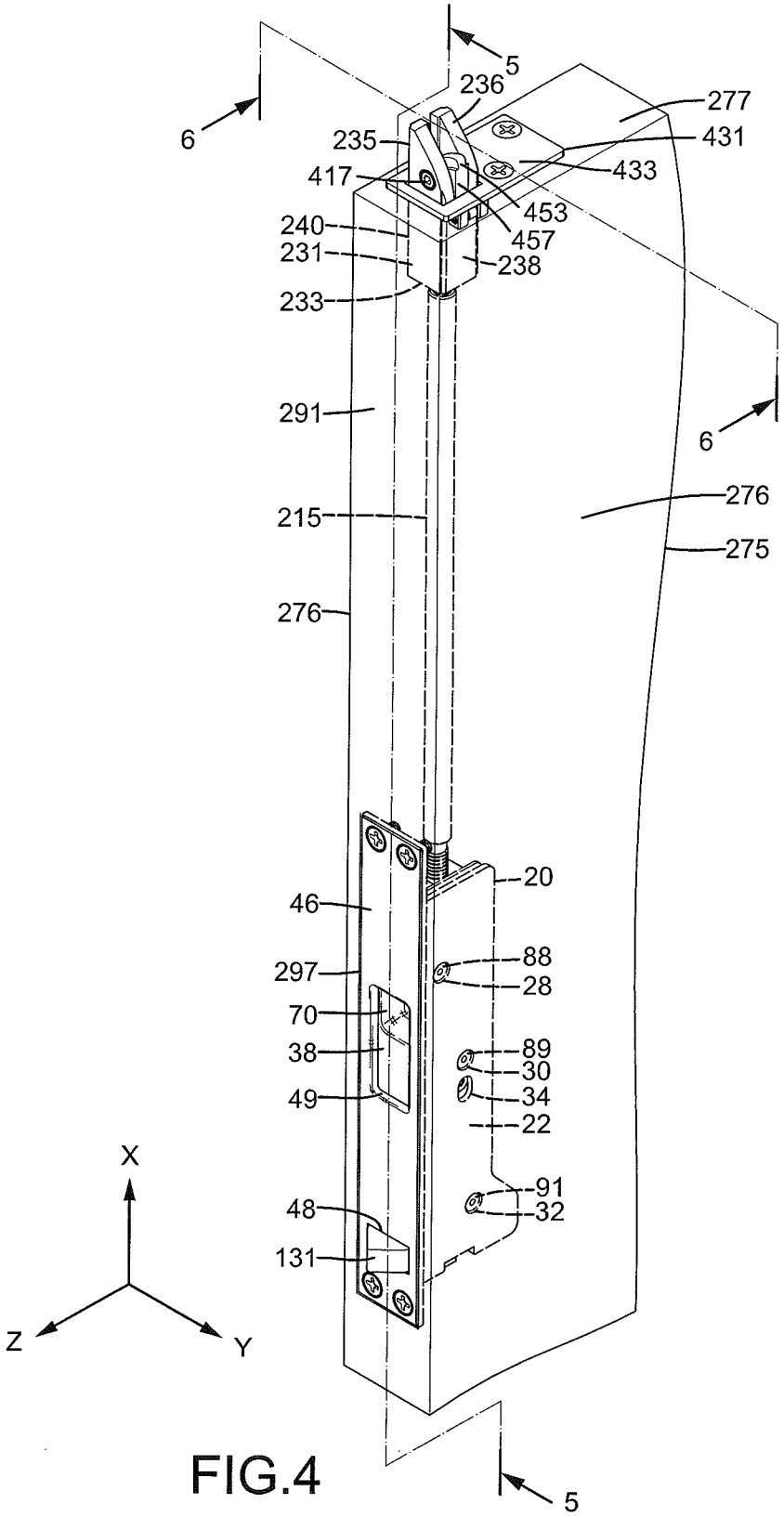
FIG. 4 is a partial, perspective view of the double door of FIG. 1.
Figure 5:
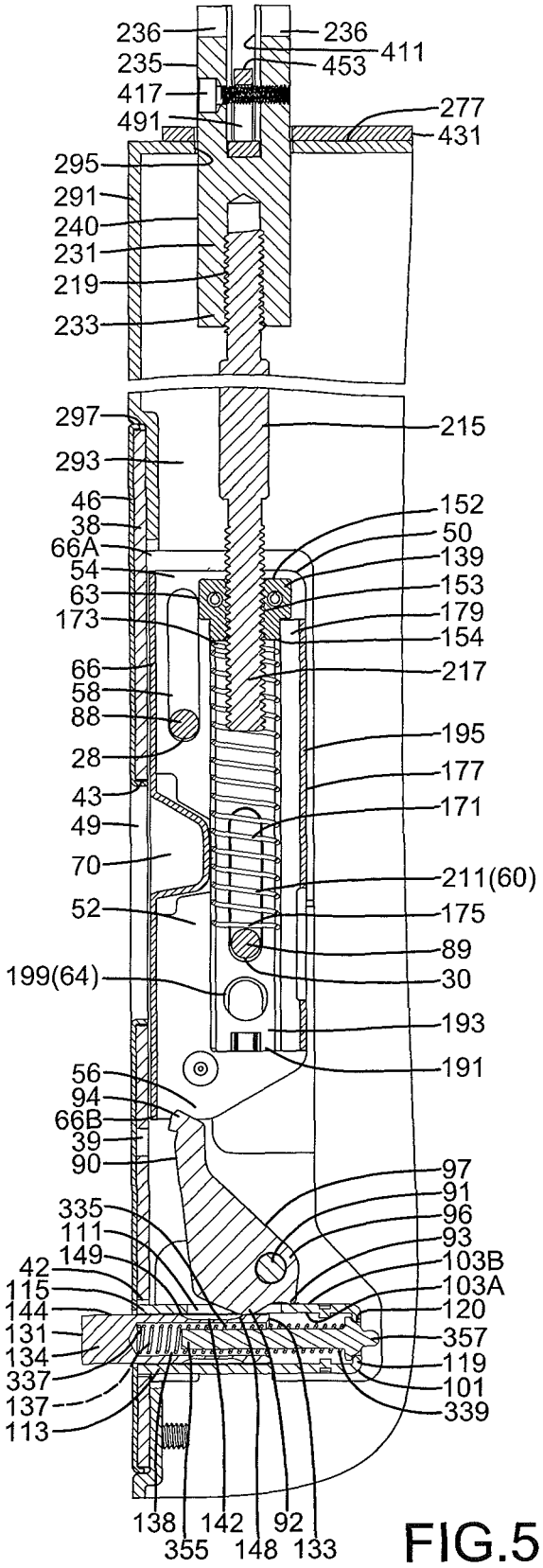
FIG. 5 is a cross sectional view taken along section line 5-5 of FIG. 4.

A coupling member 431 is mounted in top face 277 of follower door 275 (FIGS. 2, 4, and 5). Coupling member 431 includes a top face 433 and a bottom face 435 spaced from top face 433 along first axis X. A coupling hole 437 extends from top face 433 through bottom face 435. Two pivotal seats 439 are formed on bottom face 435 and located along a periphery of coupling hole 437. Each pivotal seat 439 has a cutout 451 in a center thereof. Coupling member 431 is fixed to top face 277 of follower door 275. Each pivotal seat 439 extends through mounting hole 295 into interior space 293 of follower door 275.

In the form shown, latch assembly 10 is mounted in a location adjacent to top face 277 of follower door 275. Latch assembly 10 includes a base 20 (FIG. 2) having two sidewalls 22 spaced along a second axis Y perpendicular to first axis X and an intermediate wall 38 extending between sidewalls 22. Each sidewall 22 includes a first end 24 and a second end 26 spaced from first end 24 along first axis X. Each sidewall 22 further includes a first engagement hole 28 located adjacent to first end 24, a second engagement hole 30 located between first engagement hole 28 and second end 26, and a third engagement hole 32 located in second end 26. Each sidewall 22 further includes a coupling hole 34 located between second engagement hole 30 and third engagement hole 32 and adjacent to second engagement hole 30. A slot 36 is defined in intermediate wall 38 and is adjacent to second end 26 of each sidewall 22. Slot 36 includes two edges spaced along first axis X, with a first engagement groove 42 defined in each edge of slot 36. Each sidewall 22 further includes a second engagement groove 44 in second end 26. Another slot 43 is defined in intermediate wall 38 and between slot 36 and first end 24 of each sidewall 22. Intermediate wall 38 further includes a positioning groove 39 between slots 36 and 43.

In the form shown, a faceplate 46 is mounted to intermediate wall 38, with sidewalls 22 and faceplate 46 located on two sides of intermediate wall 38. Faceplate 46 includes a first opening 48 aligned with slot 36 and a second opening 49 aligned with slot 43. Intermediate wall 38 of base 20 and faceplate 46 are engaged in engagement hole 297 of follower door 275 (FIGS. 4 and 5), with sidewalls 22 received in interior space 293 of follower door 275. Screws extend through faceplate 46 and intermediate wall 38 into end face 291 of follower door 275 to fix base 20 to follower door 275, with first end 24 of each sidewall 22 facing top beam 35 (FIG. 1).

According to the form shown, latch assembly 10 further includes a movable member 50 movably received between sidewalls 22 of base 20. Movable member 50 includes two lateral walls 52 spaced from each other along second axis Y and a connecting portion 66 extending between lateral walls 52. Each lateral wall 52 includes a first end 54 and a second end 56 spaced from first end 54 along first axis X. Each lateral wall 52 further includes a first sliding groove 58 in first end 54 and a second sliding groove 60 between second end 56 and first sliding groove 58. Each lateral wall 52 further includes two first mounting holes 63 in first end 54 and spaced from first sliding groove 58 in a third axis Z perpendicular to first and second axes X and Y. Each lateral wall 52 further includes a second mounting hole 64 between second end 56 and second sliding groove 60. Connecting portion 66 includes a first end 66A and a second end 66B spaced from first end 66A along first axis X. Connecting portion 66 further includes an actuating groove 70 between first end 66A and second sliding groove 60 along first axis X. Lateral walls 52 of movable member 50 are received between sidewalls 22 of base 20, with first engagement holes 28 of sidewalls 22 aligned with first sliding grooves 58 of lateral walls 52, with second engagement holes 30 of sidewalls 22 aligned with second sliding grooves 60, and with actuating groove 70 aligned with slot 43.

Figure 9:
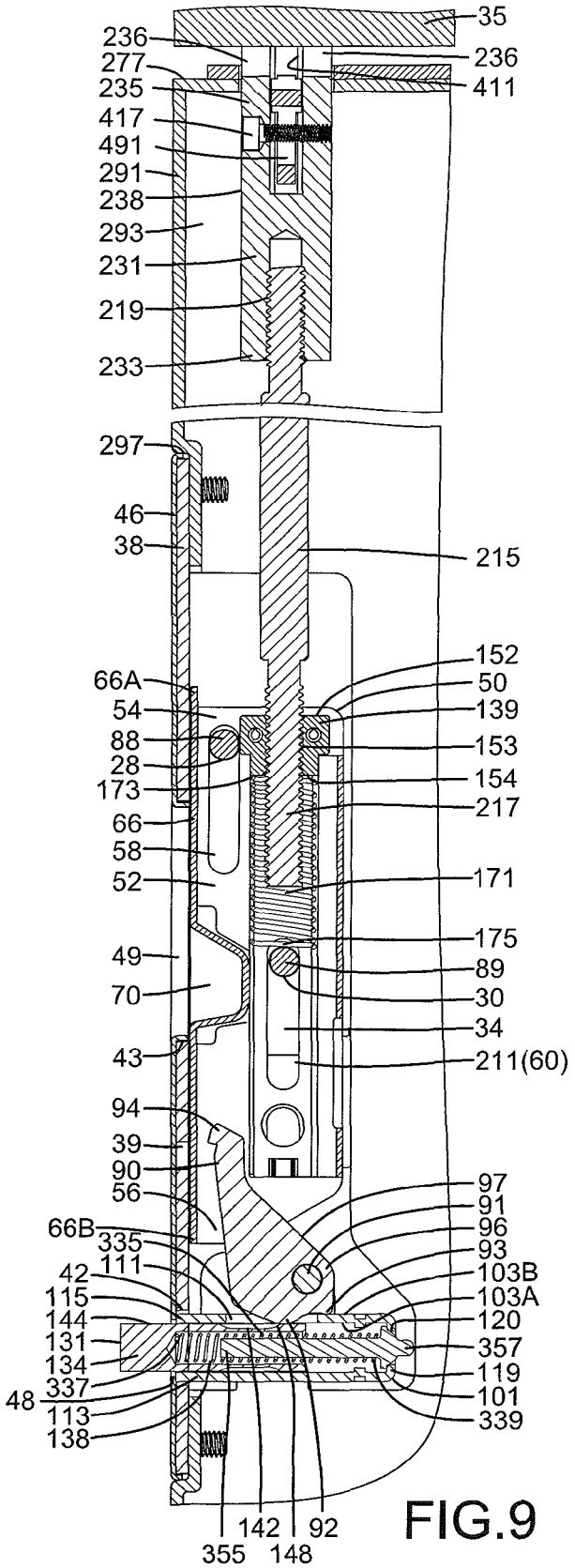
FIG. 9 is across-sectional view taken along section line 9-9 of FIG. 8.

In the form shown, a first pin 88 extends through first engagement holes 28 of sidewalls 22 of base 20 and first sliding grooves 58 of lateral walls 52 of movable member 50. A second pin 89 extends through second engagement holes 30 of sidewalls 22 of base 20 and second sliding grooves 60 of lateral walls 52 of movable member 50. First and second pins 88 and 89 maintain connecting portion 66 of movable member 50 to be parallel to intermediate wall 38 of base 20 and allow movable member 50 to move along first axis X between an engagement position (FIG. 5) and a disengagement position (FIG. 9). A spacing between first end 66A of connecting portion 66 of movable member 50 in the engagement position and first end 24 of each sidewall 22 of base 20 is smaller than a spacing between first end 66A of connecting portion 66 of movable member 50 in the disengagement position (FIG. 9) and first end 24 of each sidewall 22 of base 20. However, actuating groove 70 is located in a length of slot 43 along first axis X no matter movable member 50 is in the engagement position or the disengagement position.

According to the form shown, latch assembly 10 further includes a limiting member 90 pivotably received in base 20 and having an outer periphery 97. Limiting member 90 further includes an engagement end 94 and a pivotal portion 96. A first protrusion 92 is formed on outer periphery 97 and is adjacent to pivotal portion 96. A second protrusion 93 is formed on outer periphery 97, with first protrusion 92 located between engagement end 94 and second protrusion 93. A third pin 91 extends through third engagement holes 32 of base 20 and pivotal portion 96 of limiting member 90, with engagement end 94 of limiting member 90 facing intermediate wall 38 of base 20. Thus, limiting member 90 is pivotable about a pivot axis defined by third pin 91 between a locking position (FIG. 12) and an unlocking position (FIG. 5). When limiting member 90 is in the locking position, engagement end 94 of limiting member 90 is engaged with positioning groove 39 of base 20 and is in a movement path of movable member 50 between the engagement position and the disengagement position. Thus, movable member 50 can not move from the engagement position to the disengagement position. On the other hand, when limiting member 90 is in the unlocking position, engagement end 94 of limiting member 90 is disengaged from positioning groove 39 of base 20 and is located outside of the movement path of the movable member 50. Thus, movable member 50 can move between the engagement position and the disengagement position.

According to the form shown, latch assembly 10 further includes a limiting frame 101 fixed between sidewalls 22 of base 20 and having substantially U-shaped cross sections. Limiting frame 101 includes a first wall 103 and a second wall 113 spaced from first wall 103 along first axis X. Limiting frame 101 further includes a connecting wall 119 extending between first and second walls 103 and 113. First wall 103 includes an inner face 103A and an outer face 103B spaced from inner face 103A along first axis X. A slot 111 extends from inner face 103A through outer face 103B. A positioning hole 120 is defined in connecting wall 119. A first engagement protrusion 115 is formed on a distal edge of each of first and second walls 103 and 113. Each of first and second walls 103 and 113 includes two lateral edges spaced from each other along second axis Y. A second engagement protrusion 117 is formed on each lateral edge of second wall 113. Two wings 105 respectively extend from the lateral edges of first wall 103, with each wing 105 having a pivot hole 109.

In the form shown, each first engagement protrusion 115 of limiting frame 101 is engaged with one of first engagement grooves 42 of base 20. Each second engagement protrusion 117 of limiting frame 101 is engaged with one of second engagement grooves 44 of base 20. Thus, first and second walls 103 and 113 of limiting frame 101 are flush with the edges of slot 36. Pivot holes 109 of limiting frame 101 are aligned with third engagement holes 32 of base 20. Third pin 91 extends through pivot holes 109, third engagement holes 32, and pivotal portion 96 of limiting member 90, fixing limiting frame 101 between sidewalls 22 of base 20, with pivotal portion 96 of limiting member 90 located between wings 105, with first protrusion 92 of limiting member 90 extending through slot 111 and received between first and second walls 103 and 113, and with engagement end 94 of limiting member 90 located outside of limiting frame 101.

According to the form shown, latch assembly 10 further includes an actuation latch 131 movably received in slot 36 of base 20. Actuation latch 131 includes a base portion 132 having a first end 133 and a second end 137 spaced from first end 133 along third axis Z. Base portion 132 further includes first and second sides 144 and 146 extending between first and second end 133 and 137, with first side 144 spaced from second side 146 along first axis X. Second end 137 of base portion 132 includes a first end portion 136 and a second end portion 136 spaced from first end portion 136 along second axis Y. A wedge 134 is formed on second end 137 and is located between first and second end portions 136. Wedge 134 includes substantially triangular cross sections and includes two actuating faces 135 meeting at an edge. Actuating faces 135 are located between first and second end portions 136 along second axis Y. A groove 142 is formed in first side 144 but spaced from second side 146. Groove 142 includes a bottom wall having an inclined section 148 intersecting with and at an obtuse angle to first side 144. A hole 138 extends from first end 133 towards but spaced from second end 137 of actuation latch 131. Base portion 132 and first and second end portions 136 are located between first and second walls 103 and 113 of limiting frame 101. Actuating latch 131 is movable in slot 36 along third axis Z between a releasing position in which wedge 134 extends out of base 20 (FIG. 5) and a pressing position in which wedge 134 is received in base 20 (FIG. 12). When actuation latch 131 is in the releasing position, second end 137 abuts an inner face of intermediate wall 38 of base 20.

According to the form shown, a guiding rod 351 is mounted between actuation latch 131 and limiting frame 101. Guiding rod 351 includes a first positioning end 355 engaged with hole 138 of actuation latch 131 and a second positioning end 357 engaged with positioning hole 120 of limiting frame 101. Second positioning end 357 has an outer diameter larger than that of first positioning end 355. A spring 335 is mounted around guiding rod 351 and is located between actuation latch 131 and limiting frame 101. Spring 335 includes a first end 337 abutting against an end wall of hole 138 and a second end 339 abutting against second positioning end 357. Spring 335 biases actuation latch 131 from the pressing position to the releasing position. Guiding rod 351 avoids distortion of spring 335 while actuation latch 131 moves from the releasing position to the pressing position and compresses spring 335.

According to the form shown, a locking block 139 is mounted to lateral walls 52 of movable member 50. Locking block 139 includes a first surface 152 and a second surface 154 spaced from first surface 152 along first axis X. Two fixing holes 511 extend from a side of locking block 139 to another side of locking block 139 along second axis Y. A locking hole 153 in the form of a screw hole extends from first surface 152 through second surface 154. Locking block 139 is mounted between lateral walls 52 of movable member 50 and is located on first ends 54 of lateral walls 52 of movable member 50. Two pins 513 extend through first mounting holes 639 and fixing holes 511 to fix locking block 139 to movable member 50. Locking block 139 is jointly movable with movable member 50 between the engagement position and the disengagement position along first axis X.

In the form shown, a spring 171 is mounted between locking block 139 and second pin 89. Spring 171 includes a first end 173 abutting against second surface 154 of locking block 139 and a second end 175 abutting against second pin 89. Spring 171 biases movable member 50 and locking block 139 from the disengagement position to the engagement position (FIG. 5).

According to the form shown, latch assembly 10 further includes a restraining member 177 mounted in movable member 50. Restraining member 177 includes two sides 193 spaced from each other along second axis Y. Restraining member 177 further includes a connecting section 195 extending between sides 193. Spring 171 is received in a space defined by sides 193 and connecting section 195 of restraining member 177. Each side 193 includes a first end 179 and a second end 191 spaced from first end 179 along first axis X. Each side 193 further includes a slot 211 between first and second ends 179 and 191. A mounting hole 199 is defined in second end 191 of each side 193, with slot 211 located between first end 179 and mounting hole 199. Sides 193 of restraining member 177 are located between lateral walls 52 of movable member 50, with slots 211 aligned with second sliding grooves 60, and with mounting holes 199 aligned with second mounting holes 64. Second pin 89 extends through second engagement holes 30 of base 20, second sliding grooves 60 of movable member 50, and slots 211 of restraining member 177. First end 179 of each side 193 of restraining member 177 has an end face abutting second surface 154 of locking block 139. Second end 191 of each side 193 of restraining member 177 is adjacent to second end 56 of movable member 50. Slots 211 allow joint movement of restraining member 177 and movable member 50 between the engagement position and the disengagement position. Restraining member 177 avoids distortion of spring 171 while movable member 50 moves towards the engagement position and compresses spring 171.

In the form shown, a connecting rod 215 is engaged with locking block 139. Specifically, connecting rod 215 includes a first end 217 having an outer threading engaged with locking hole 153 of locking block 139. Connecting rod 215 further has a second end 219 to which a latch 231 is engaged. Latch 231 includes an engagement end 233 engaged with second end 219 of connecting rod 215 and a locking end 235. Latch 231 further includes a first surface 238 and a second surface 240 spaced from first surface 238 along second axis Y. Locking end 235 has a slant face 236 at an obtuse angle (about 135°) to first surface 238 and at an acute angle (about 45°) to second surface 240. A cutout 411 extends from an end face of locking end 235 towards but spaced from engagement end 233 along first axis X. Cutout 411 extends to first and second surfaces 238 and 240 and slant face 236. Cutout 411 includes a bottom face 413 between locking end 235 and engagement end 233. A pivotal hole 415 extends from an outer face of locking end 235 to cutout 411 along third axis X.

Figure 6:
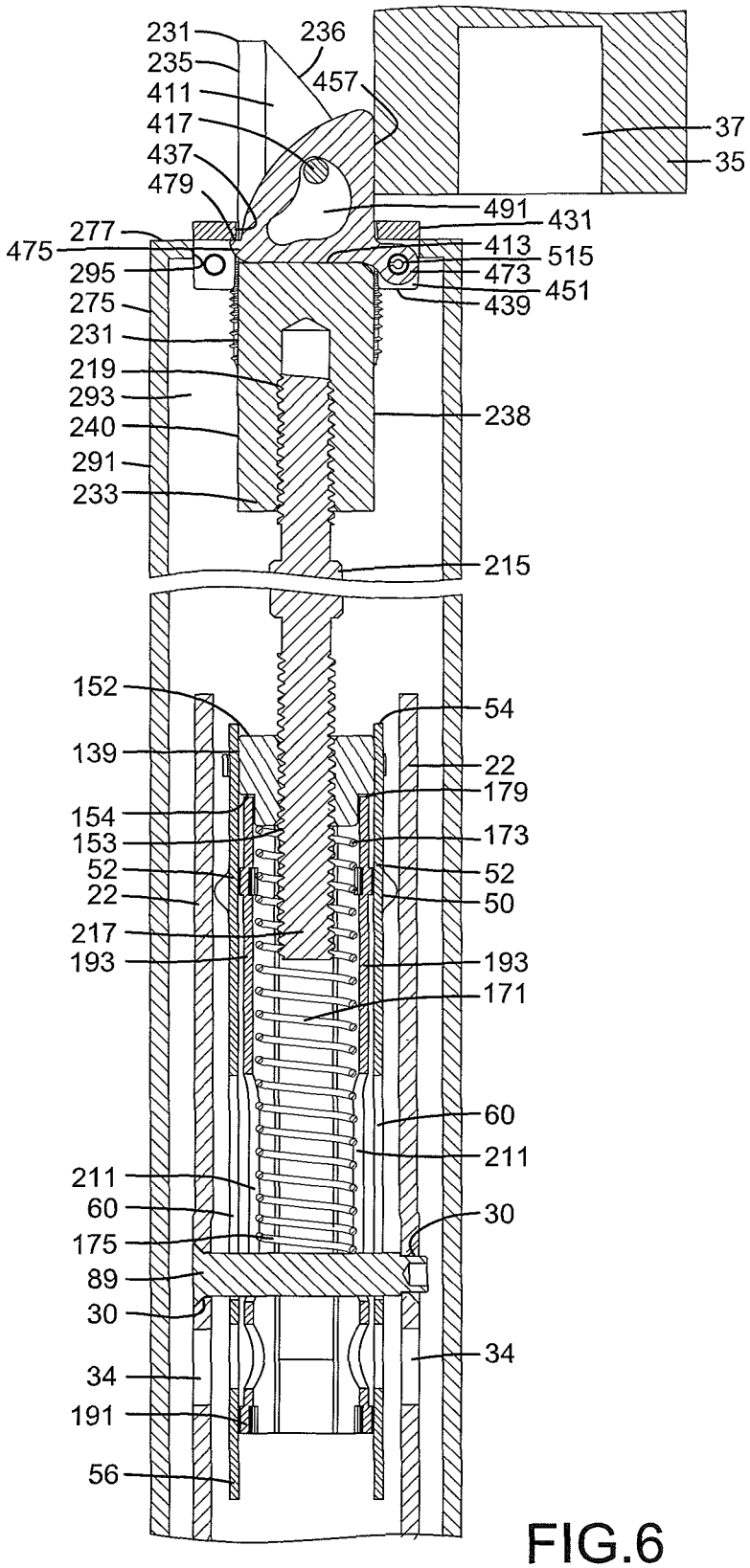
FIG. 6 is a cross sectional view taken along section line 6-6 of FIG. 4.
Figure 8:
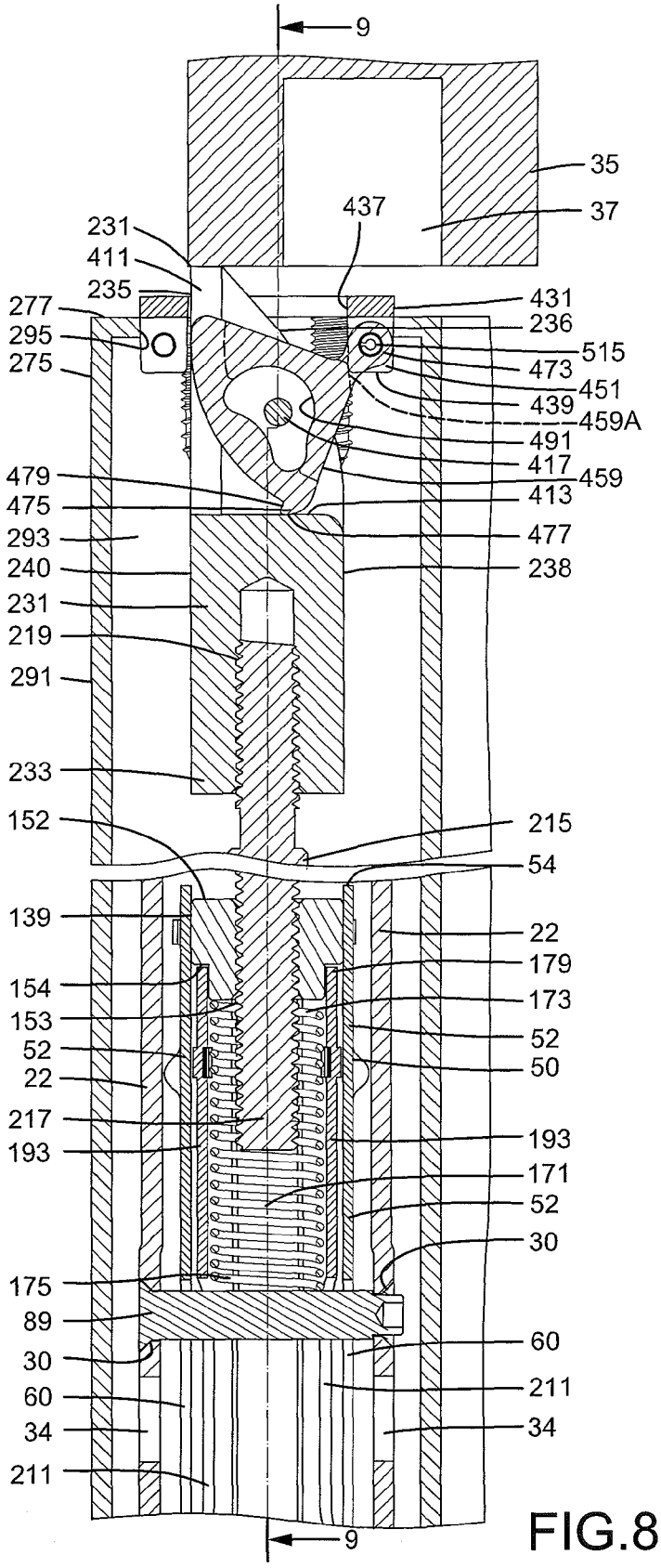
FIG. 8 is a view similar to FIG. 6, with the follower door pivoted from the open position to the closed position, and with the latch pivoted to a latching position.

First surface 238 and slant face 236 of latch 231 face top beam 35 (FIG. 6). Connecting rod 215 and latch 231 are movable together with locking block 139 and movable member 50 along first axis X between the engagement position and the disengagement position. When movable member 50 is in the engagement position, latch 231 is in a latching position (FIG. 5). When movable member 50 is in the disengagement position, latch 231 is in an unlatching position (FIGS. 8 and 9). When latch 231 is in the unlatching position, the end face of locking end 235 is located below top beam 35 along first axis X. When latch 231 is in the latching position, locking end 235 of latch 231 extends out of coupling member 431 via mounting hole 295 of follower door 275 and coupling hole 437. Latch 231 is not aligned with groove 37 when follower door 275 is in the open position. Latch 231 is aligned with groove 37 when follower door 275 is in the closed position.

Latch assembly 10 further includes a pressing board 453 received in cutout 411 of latch 231. Pressing board 453 includes two lateral sides 455 spaced from each other along third axis Z. Pressing board 453 further includes a pressing side 457 extending between lateral sides 455 and having first and second ends. Pressing board 453 further includes an abutment side 459 extending between lateral sides 455. Abutment side 459 includes a first end connected to the second end of pressing side 457 and a second end. Pressing board 453 further includes an arcuate side 471 extending between lateral sides 455. Arcuate side 471 includes a first end connected to the second end of abutment side 459 and a second end connected to the first end of pressing side 457. Pressing board 453 is sector-like in cross section. A pivotal portion 473 is formed between the second end of pressing side 457 and the first end of abutment side 459 and is located between lateral sides 455 along third axis Z. A width of pivotal portion 473 along third axis Z is smaller than a spacing between lateral sides 455 along third axis Z. Thus, pressing side 457, abutment side 459, and pivotal portion 473 define two stop portions 459A spaced from each other along third axis Z. Furthermore, an actuating portion 475 is formed between the second end of abutment side 459 and the first end of arcaute side 471. Actuating portion 475 includes an arcuate face 477 connected to the second end of abutment side 459. A stop face 479 is formed between arcaute face 477 and arcuate side 471. A through-hole 491 extends from one of lateral sides 455 through the other lateral side 455.

A screw 417 extends through pivotal hole 415 of latch 231 and through-hole 491 of pressing board 453 into a screw hole in a wall of cutout 411, preventing pressing board 453 from disengaging from latch 231. Pressing side 457 faces first surface 238 of latch 231 in the latching position. A portion of pressing side 457 adjacent to the first end of pressing side 457 is located outside of slant face 236 of latch 231. Abutment side 459 faces bottom face 413 of cutout 411 of latch 231 in the latching position. Pivotal portion 473 is received in cutouts 451 of one of pivotal seats 439 (the corresponding pivotal seat 439) of coupling member 431. An axle 515 extends through the corresponding pivotal seat 439 and pivotal portion 473 of pressing board 453. Note that coupling member 431 does not have to include the other pivotal seat 439 without axle 515.

When latch 231 is in the latching position, abutment side 459 of pressing board 453 contacts bottom face 413 of cutout 411 of latch 231 in the form shown. Furthermore, the first end of pressing side 457 of pressing board 453 and the second end of arcuate side 471 are located outside of slant face 236 of latch 231. Further, stop face 479 abuts bottom face 435 of coupling member 431.

Now that the basic construction of latch assembly 10 has been explained, the operation and some of the advantages of latch assembly 10 can be set forth and appreciated. In particular, for the sake of explanation, it will be assumed that primary door 259 is in an open position and the follower door 275 is in the open position (FIGS. 5 and 6). Latch 231 and pressing board 453 are not aligned with groove 37 of top beam 35 of door frame 31. End face 273 of primary door 259 is not aligned with end face 291 of follower door 275. Actuating latch 131 is not pressed and is in the releasing position (FIG. 5). Movable member 50 is in the engagement position. Latch 231 is in the latching position. Limiting member 90 is in the unlocking position (FIG. 5) such that engagement end 94 of limiting member 90 is located outside of the movement path of the movable member 50 between the engagement position and the disengagement position. Thus, movable member 50 can be driven to move from the engagement position to the disengagement position.

Figure 7B:
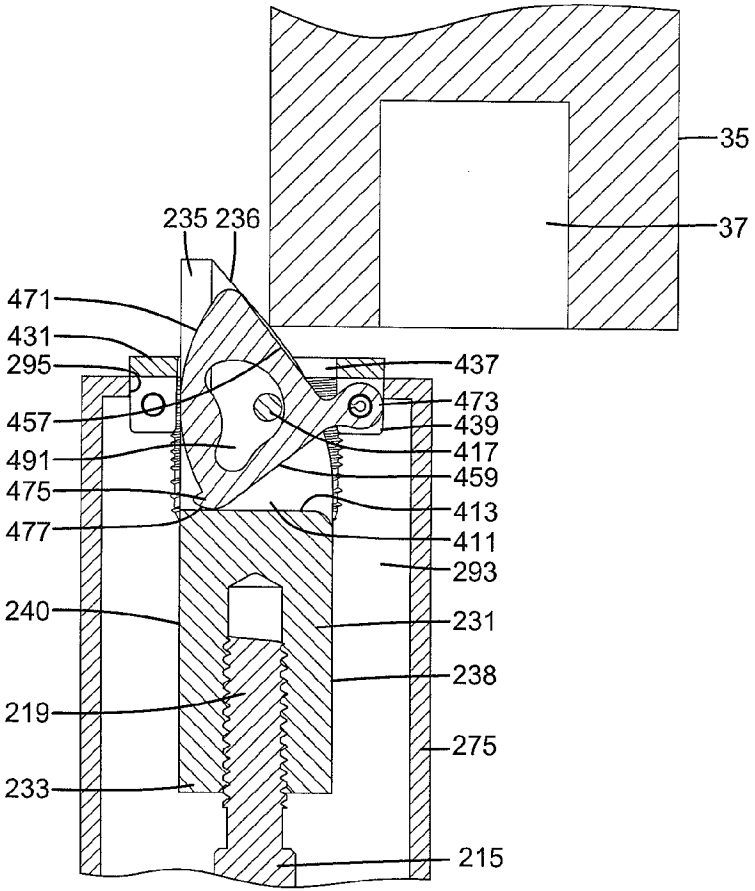
FIG. 7B is a view similar to FIG. 7A, with the follower door further pivoted from the open position toward the closed position, and with the latch pressed by the top beam.
Figure 7A:
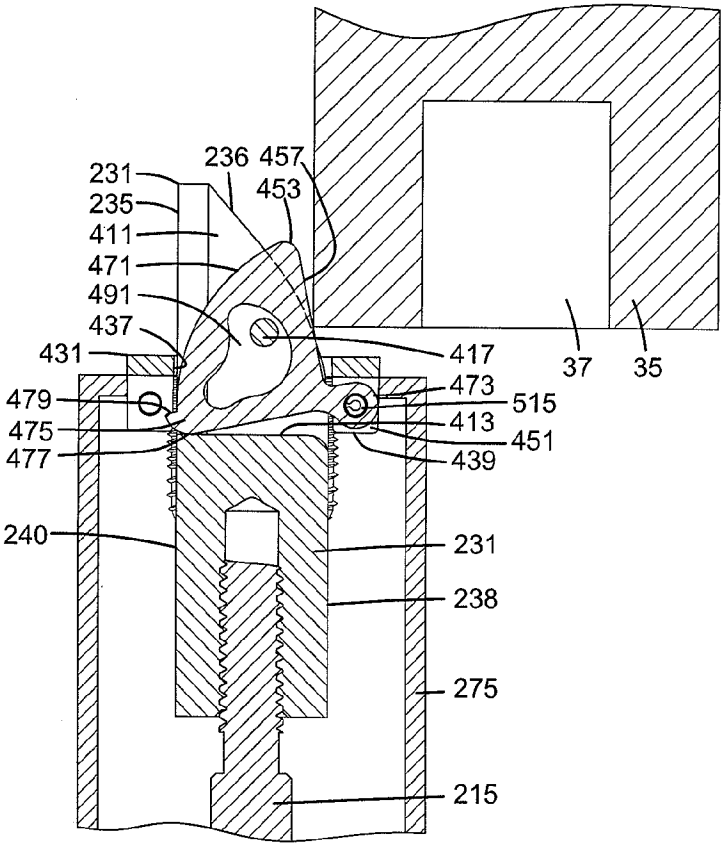
FIG. 7A shows an upper portion of the double door of FIG. 6, with a follower door pivoted from an open position toward a closed position, and with the pressing board pressed by a top beam and pivoted.

When follower door 275 is moved from the open position to the closed position, follower door 275 keeps moving toward the closed position after pressing side 457 of pressing board 453 presses against top beam 35. Arcuate face 477 of actuating portion 475 presses against bottom face 413 of cutout 411 of latch 231 to move latch 231 from the latching position toward the unlatching position (FIG. 7A) until pressing side 457 of pressing board 453 completely enters cutout 411 of latch 231 (FIG. 7B). Thus, slant face 236 of latch 231 presses against top beam 35 such that follower door 275 keeps moving toward the closed position. Top beam 35 presses against slant face 236 of latch 231 to move latch 231 to the unlatching position located below top beam 35 along first axis X (FIGS. 8 and 9). Furthermore, when latch 231 reaches the unlatching position, stop portions 459A abuts outer sides of the corresponding pivotal seat 439 of coupling member 431 to avoid actuating portion 475 of pressing board 453 from pivoting out cutout 411 of latch 231 under the action of gravitational force. This assures pressing board 453 to pivot back to its initial position when latch 231 moves from the unlatching position to the latching position.

When follower door 275 reaches the closed position, spring 171 biases locking block 139 to move latch 231 from the latching position to the unlatching position (FIG. 10). While latch 231 is moving from the latching position to the unlatching position, bottom face 413 of cutout 411 of latch 231 presses against arcuate face 477 of actuating portion 475 of pressing board 453 to pivot pressing board 453 in a reverse direction. Pressing board 453 moves back to its initial position when latch 231 reaches the latching position.

Note that through-hole 491 of pressing board 453 provides room for movement of screw 417 while latch 231 is moving between the latching and unlatching positions. Engagement of latch 231 and pressing board 453 by screw 417 allows a user to easily install latch assembly 10. Specifically, engagement of pressing board 453 and latch 231 must be done in a specific orientation. Pressing board 453 and latch 231 already engage with each other after manufacture of latch assembly 10. When the user is installing latch assembly 10, the user only has to pivotally connect pivotal portion 473 of pressing board 453 to the corresponding pivotal seat 439 of coupling member 431, avoiding the mistake in the engagement orientation of the pressing board 453 which could lead to problems in use.

Furthermore, first protrusion 92 of limiting member 90 abuts against and is, thus, stopped by first side 144 of actuation latch 131, retaining limiting member 90 in the locking position. Specifically, first protrusion 92 should pivot along first axis X towards second side 146 of actuating latch 131 when it is intended to pivot limiting member 90 about the pivot axis defined by third pin 91 from the unlocking position to the locking position. However, first protrusion 92 is stopped by first side 144 of actuation latch 131 and, thus, retains the limiting member 90 in the unlocking position. Furthermore, when limiting member 90 is in the unlocking position, second protrusion 93 abuts against outer face 103B of first wall 103 of limiting frame 101 such that engagement end 94 of limiting member 90 in the unlocking position can not pivot about the pivot axis defined by third pin 91 in a direction away from intermediate wall 38 of base 20, reliably retaining limiting member 90 in the unlocking position.

When follower door 275 pivots from the open position to closed position about first axis X, latch 231 moves from the latching position to the unlatching position. At the same time, connecting rod 215 moves together with locking block 139 and compresses spring 171. Locking block 139 and movable member 50 move jointly from the engagement position to the disengagement position. When follower door 275 keeps moving and reaches the closed position in which latch 231 is aligned with groove 37 of top beam 35, spring 171 biases locking block 139, causing movable member 50 and restraining member 177 to move along first axis X from the disengagement position to the engagement position. At the same time, connecting rod 215 moves together with locking block 139 to move latch 231 along first axis X from the unlatching position (FIGS. 8 and 9) to the latching position (FIGS. 10 and 11) in which latch 231 enters and engages with groove 37.

After follower door 275 reaches the closed position (FIG. 11) in which latch 231 is in the latching position and engages with groove 37, primary door 259 is moved to the closed position in which end face 273 of primary door 259 is aligned with end face 291 of follower door 275. Latch 333 of door lock 319 is engaged in receptacle 294 of follower door 275, and second opening 49 of faceplate 46 is covered by end face 273 of primary door 259, such that movable member 50 can not be moved to the disengagement position via actuating groove 70. Furthermore, end face 273 of primary door 259 presses against one of actuating faces 135 of actuation latch 131, causing actuation latch 131 to move along third axis Z from the releasing position towards the pressing position while compressing spring 335. After end face 273 of primary door 259 is aligned with end face 291 of follower door 275 (FIG. 12), actuation latch 131 is in the pressing position, and groove 142 of actuation latch 131 is aligned with first protrusion 92 of limiting member 90. Due to the gravitational force of engagement end 94, limiting member 90 pivots about the pivot axis defined by third pin 91 from the unlocking position (FIG. 11) to the locking position (FIG. 12) in which engagement end 94 engages with positioning groove 39 of base 20. In this case, second protrusion 93 of limiting member 90 is spaced from outer face 103B of limiting frame 101, and engagement end 94 of limiting member 90 is in the movement path of movable member 50 between the engagement position and the disengagement position. Namely, engagement end 94 of limiting member 90 is located below second end 66B of connecting portion 66 of movable member 50 along first axis X. Thus, movement of movable member 50 from the engagement position to the disengagement position is stopped by limiting member 90, avoiding movement of latch 231 to the unlatching position. Picking of latch 231 is, thus, avoided.

Latch assembly 10 uses pressing board 453 to press against and move latch 231 from the latching position to the unlatching position without the need of a faceplate on the door frame 31. Thus, the follower door can smoothly be moved to the closed position while avoiding the disadvantage of loosening of the faceplate causing potential operational difficulties of latch 231 in disengaging from top beam 35.

Latch 231 can not be moved from the latching position to the unlatching position while both of primary door 259 and follower door 275 are in their closed positions. When it is desired to move latch 231 from the latching position to the unlatching position, handle 331 of door lock 319 must be pivoted to retract latch 333, and primary door 259 must be moved to a position in which end face 273 of primary door 259 is spaced from end face 291 of follower door 275 to allow access to actuating groove 70 of movable member 50 via engagement hole 297 of follower door 275 (FIG. 11). Actuation latch 131 is moved from the pressing position to the releasing position under action of spring 335. Inclined section 148 of groove 142 of actuation latch 131 pushes first protrusion 92 of limiting member 90, causing pivotal movement of limiting member 90 from the locking position to the unlocking position about the pivot axis defined by third pin 91. Thus, a user can extend his or her finger into actuation groove 70 to move movable member 50 from the engagement position to the disengagement position about first axis X, moving latch 231 from the latching position to the unlatching position. Then, follower door 275 can be moved from the closed position to the open position.

Now that the basic teachings of the present invention have been explained, many extensions and variations will be obvious to one having ordinary skill in the art. For example, latch assembly 10 does not have to include screw 417, and latch 231 does not have to include through-hole 491. Pivotal portion 473 of pressing board 453 can still be pivotably mounted to coupling member 431 without using screw 417. Furthermore, latch 231, pressing board 453, and coupling member 431 can be used on latch assemblies 10 of other types.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly comprising: a base including two sidewalls and an intermediate wall extending between the two sidewalls, with a slot defined in the intermediate wall, with the intermediate wall of the base adapted to be mounted to an end face of a follower door of a double door further including a primary door, with the follower door including an interior space, with the two sidewalls adapted to be received in the interior space of the follower door, with the follower door pivotable between a closed position and an open position; a movable member received between the two sidewalls of the base and movable along a first axis between an engagement position and a disengagement position, with the movable member including two lateral walls spaced from each other along a second axis perpendicular to the first axis, with the movable member further including a connecting portion extending between the two lateral walls, with the movable member further including an actuating groove defined in the connecting portion, with the actuating groove aligned with the slot of the base; a latch including an engagement end fixedly coupled to the movable member, with the latch further including a locking end having a slant face, with the latch further including a first surface and a second surface spaced from the first surface along the second axis, with the latch further including a cutout extending from an end face of the locking end toward the engagement end along the first axis and terminating in a bottom face spaced from the engagement end, with the bottom face located between the locking end and the engagement end, with the cutout extending to the first and second surfaces and the slant face of the latch, with the latch and the movable member jointly movable, with the latch movable along the first axis between a latching position corresponding to the engagement position of the movable member and an unlatching position corresponding to the disengagement position of the movable member, with the locking end of the latch in the unlatching position being adapted to be received in the follower door, with the locking end of the latch in the latching position adapted to extend out of the follower door into a groove in a top beam of a door frame to which the follower and primary doors are pivotably mounted; a pressing board received in the cutout of the latch, with the pressing board including two lateral sides spaced from each other along a third axis perpendicular to the first and second axes, with the pressing board further including a pressing side extending between the two lateral sides, with the pressing side having first and second ends, with the pressing board further including an abutment side extending between the two lateral sides, with the abutment side including a first end connected to the second end of the pressing side and a second end, with the pressing board further including an arcuate side extending between the two lateral sides, with the arcuate side including a first end connected to the second end of abutment side and a second end connected to the first end of pressing side, with a pivotal portion formed between the second end of the pressing side and the first end of the abutment side, with an actuating portion formed between the second end of the abutment side and the first end of the arcuate side, with the pressing side facing the first surface of the latch in the latching position, with a portion of the pressing side adjacent to the first end of the pressing side located outside of the slant face of the latch, with the abutment side facing the bottom face of the cutout of the latch in the latching position; and a coupling member including a top face and a bottom face spaced from the top face along the first axis, with the coupling member further including a coupling hole extending from the top face through the bottom face of the coupling member, with the pivotal portion of the pressing board pivotably mounted to the coupling member, with the latch and the pressing board extending through the coupling hole, with the coupling member adapted to be fixed to a top face of the follower door, wherein when the follower door is in the open position, the latch is not aligned with the groove of the top beam and is in the latching position, wherein when the follower door is in the closed position, the latch is aligned with the groove of the top beam and is in the latching position, wherein when the follower door moves from the open position to the closed position, the pressing side of the pressing board is pressed by the top beam of the door frame, the pressing board pivots such that the actuating portion presses against the bottom face of the cutout of the latch, moving the latch towards the unlatching position until the pressing side of the pressing board completely enters the cutout of the latch, and then the slant face of the latch presses against the door frame, causing further movement of the latch such that it reaches the unlatching position, wherein the latch is moved from the unlatching position to the latching position when the follower door is moved into the closed position such that the latch extends into the groove of the top beam, wherein when an end face of the primary door is not aligned with the end face of the follower door, the movable member is moved from the engagement position to the disengagement position by the actuating groove to cause movement of the latch from the latching position to the unlatching position.

2. The latch assembly as claimed in claim 1, with the pivotal portion of the pressing board including a width along the third axis smaller than a spacing between the two lateral sides of the pressing board along the third axis, with the pressing side, the abutment side, and the pivotal portion defining two stop portions spaced from each other along the third axis, with a pivotal seat formed on the bottom face of the coupling member and located along a periphery of the coupling hole of the coupling member, with the pivotal portion of the pressing board pivotably mounted to the pivotal seat of the coupling member, with the pivotal seat including two outer surfaces, wherein when the latch is in the latching position, the two stops portions abut against the outer surfaces of the pivotal seat of the coupling member, preventing the actuating portion of the pressing board from disengaging from the cutout of the latch.

* * * * *